US007571790B2

(12) United States Patent
Kim

(10) Patent No.: US 7,571,790 B2
(45) Date of Patent: Aug. 11, 2009

(54) SOUND ABSORPTION BLOCK AND METHOD OF CONSTRUCTING THE SAME

(76) Inventor: Bae-Young Kim, 642 Mojeong-Ri, Gunseo-Meon, Yeongam-Gum, Jeollanam-Do 526-853 (KR)

( * ) Notice: Subject to any disclaimer, the term of this patent is extended or adjusted under 35 U.S.C. 154(b) by 414 days.

(21) Appl. No.: 11/570,498

(22) PCT Filed: Jun. 30, 2005

(86) PCT No.: PCT/KR2005/002071

§ 371 (c)(1),
(2), (4) Date: Dec. 12, 2006

(87) PCT Pub. No.: WO2006/004353

PCT Pub. Date: Jan. 12, 2006

(65) Prior Publication Data

US 2008/0047779 A1 Feb. 28, 2008

(30) Foreign Application Priority Data

Jun. 30, 2004 (KR) ..... 10-2004-0050402

(51) Int. Cl.
*E04B 1/82* (2006.01)

(52) U.S. Cl. ..... 181/293; 181/30; 181/210; 181/285; 181/286; 181/287; 181/290; 181/295; 52/144; 52/145; 362/190; 362/191; 362/192

(58) Field of Classification Search ..... 181/30, 181/210, 285, 286, 287, 290, 293, 295; 52/144, 52/145; 362/190, 191, 192
See application file for complete search history.

(56) References Cited

U.S. PATENT DOCUMENTS

| | | | | | |
|---|---|---|---|---|---|
| 2,153,357 | A | * | 4/1939 | Wente | 181/291 |
| 2,710,335 | A | * | 6/1955 | Wong | 362/148 |
| 2,771,164 | A | * | 11/1956 | Scurlock | 52/404.1 |
| 2,792,164 | A | * | 5/1957 | Cauffiel | 182/194 |
| 2,913,075 | A | * | 11/1959 | Zittle | 428/56 |
| 3,026,224 | A | * | 3/1962 | Rogers, Jr. | 428/167 |
| 3,498,405 | A | * | 3/1970 | Charpentier | 181/291 |
| 3,501,878 | A | * | 3/1970 | Segal | 52/144 |

(Continued)

FOREIGN PATENT DOCUMENTS

DE 3631257 A1 * 5/1987

(Continued)

*Primary Examiner*—Jeffrey Donels
*Assistant Examiner*—Jeremy Luks
(74) *Attorney, Agent, or Firm*—IPLA P.A.; James E. Bame

(57) ABSTRACT

A sound absorption block installed at a music box, a gymnasium, a studio, etc. to prevent sounds from being heard outside, and a method of constructing the same are disclosed. The present invention provides a sound absorption block, including a lower plate where a plurality of unit structures are regularly arranged in horizontal and vertical directions, the unit structure having rectangular an opening that becomes gradually smaller; and an upper plate arranged on the lower plate to divide each of the openings of the unit structures in four parts. Accordingly, the sound absorption block of the present invention may be made of metals, as well as inexpensive building residues, etc. because a sound wave was decreased and offset regardless of the materials.

10 Claims, 2 Drawing Sheets

U.S. PATENT DOCUMENTS

| | | | | | |
|---|---|---|---|---|---|
| 3,804,196 | A | * | 4/1974 | Horn et al. | 181/285 |
| 3,814,208 | A | * | 6/1974 | Morresi et al. | 181/293 |
| 3,861,493 | A | * | 1/1975 | Payne | 181/293 |
| 4,261,433 | A | * | 4/1981 | Propst | 181/286 |
| 4,425,981 | A | * | 1/1984 | Kiesewetter et al. | 181/286 |
| 4,555,433 | A | * | 11/1985 | Jablonka et al. | 428/166 |
| 4,971,850 | A | * | 11/1990 | Kuan-Hong | 428/137 |
| 5,551,198 | A | * | 9/1996 | Schaaf et al. | 52/604 |
| 5,587,564 | A | * | 12/1996 | Stief et al. | 181/295 |
| 5,641,950 | A | * | 6/1997 | Kotter | 181/285 |
| 5,983,585 | A | * | 11/1999 | Spakousky | 52/405.4 |
| 6,213,252 | B1 | | 4/2001 | Ducharme | |
| 6,274,216 | B1 | | 8/2001 | Gonidec et al. | |
| 2004/0065506 | A1 | * | 4/2004 | Salls | 181/285 |

FOREIGN PATENT DOCUMENTS

| | | | |
|---|---|---|---|
| EP | 0214524 | | 3/1987 |
| JP | 52-4615 | | 1/1977 |
| JP | 02288105 | A * | 11/1990 |
| JP | 03161603 | A * | 7/1991 |

* cited by examiner

[Fig. 1]
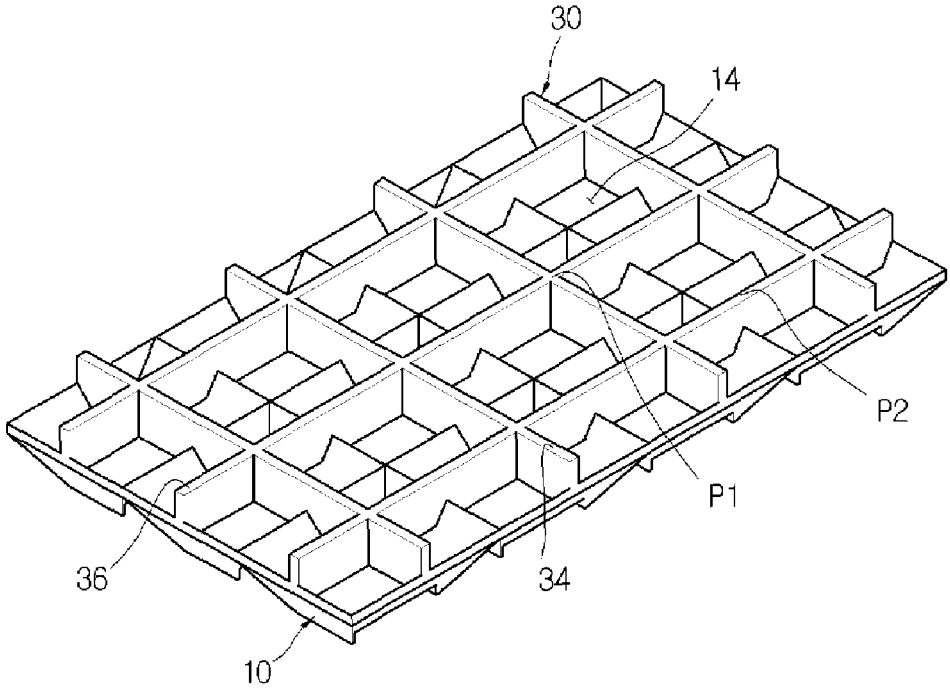
[Fig. 2]
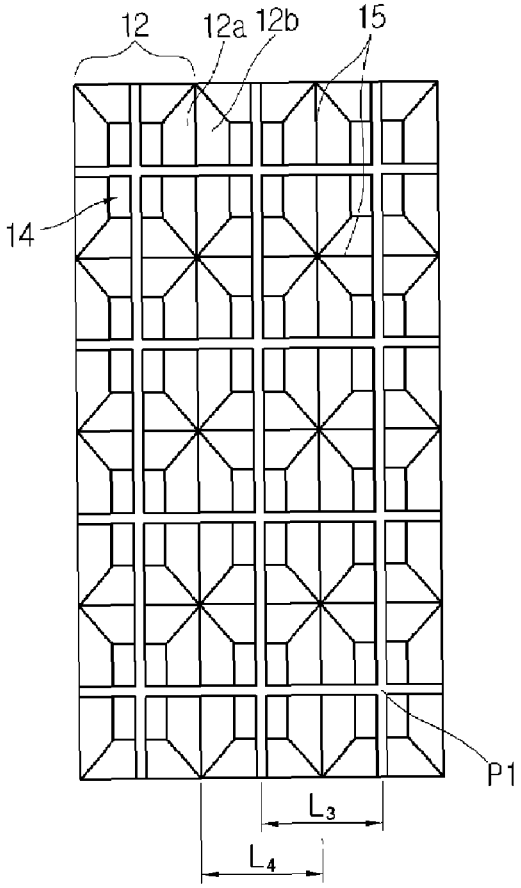

[Fig. 3]
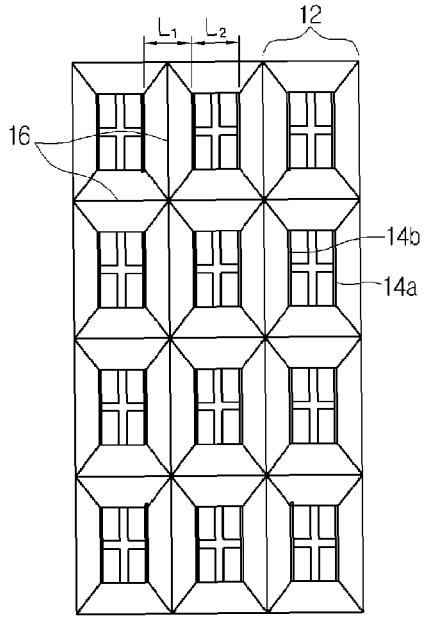
[Fig. 4]
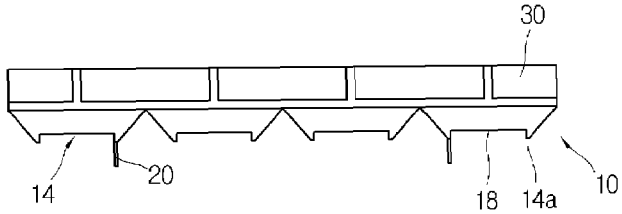
[Fig. 5]
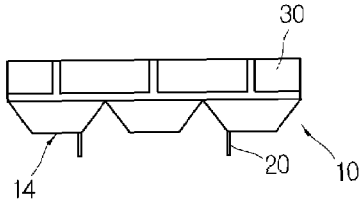
[Fig. 6]
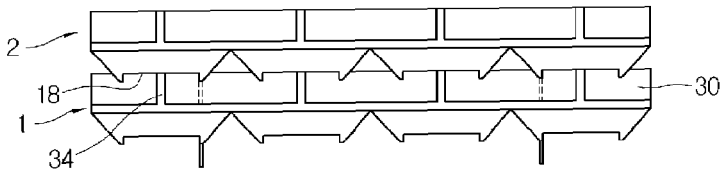
[Fig. 7]
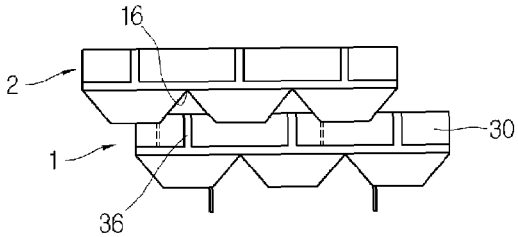

SOUND ABSORPTION BLOCK AND METHOD OF CONSTRUCTING THE SAME

TECHNICAL FIELD

The present invention relates to a sound absorption block and a method of constructing the same, and more particularly to a sound absorption block installed at a music box, a gymnasium, a studio, etc. to prevent sounds from being heard outside, and a method of constructing the same.

BACKGROUND ART

Soundproofing is generally divided into two categories: one is absorbing sounds, and the other is insulating sounds. Mainly, styrofoam, sponge, cork, paper egg tray, etc. has been used for sound absorption and polymers such as a concrete has been used for sound insulation.

Referring to a principle of the sound absorption, the sound absorption is divided into two sub-categories. One is a principle of absorbing sounds with a certain material, and for example porous materials such as sponge, cork, etc. may be sued to absorb sounds. On the while, and the other is a principle of using vibration of membrane of a board or a fabric to absorb sounds.

However, the above conventional sound absorbers have many problems. For example, soundproof materials made of wood or plastic resin are vulnerable to fire due to their fragility to heat, and glass fiber, rock wool, etc. not only become the cause of environmental pollution due to floating dust, but also generate toxic gases when a fire breaks out.

Also, there was developed a soundproof panel with a perforated structure wherein a perforated thin panel is attached to a surface of a material such as glass fiber, rock wool, plastic resin, etc., but the soundproof panel is difficult to solve intrinsic defects presented by glass fiber, plastic resin, etc., and also its manufacturing process is very complex and requires much costs upon its construction.

DISCLOSURE OF INVENTION

Technical Problem

Accordingly, the present invention is designed to solve the problems of the prior art, and therefore it is an object of the present invention to provide a sound absorption block in which the construction is easy and a manufacturing cost is significantly lowered by systemically isolating a sound wave, and simultaneously simplifying its structure regardless of the materials, and a method of constructing the same.

Technical Solution

In order to accomplish the above object, the present invention provides a sound absorption block includes a lower plate in which a plurality of unit structures are regularly arranged in horizontal and vertical directions, the unit structure having a rectangular opening that becomes gradually smaller in a thickness direction of the lower plate; and an lattice-patterned upper plate disposed on the lower plate so as to divide the opening of each unit structure into four parts.

Preferably, the opening of the lower plate becomes gradually smaller with an angle of 30° in a thickness direction, and a lattice-patterned groove is formed around each opening in a bottom surface of the lower plate.

Preferably, one sidewall of the unit structure forms a triangle with one sidewall of a neighboring unit structure, and simultaneously a base line of the triangle has the same length as a width of the opening on the same line, and the unit structure also has the same length as a line width of the upper plate on the same line.

In addition, a plurality of stacking protrusions are preferably provided on a bottom surface of the lower plate, and a slit groove is also preferably formed in the opening of the lower plate to guide a location of the lower plate of the sound absorption block that is stacked.

According to another aspect of the present invention, the present invention provides a method of constructing the sound absorption block, which stacks at least two sound absorption blocks to cross each other, each sound absorption block including a lower plate in which a plurality of unit structures are regularly arranged in horizontal and vertical directions, the unit structure having a rectangular opening that becomes gradually smaller in a thickness direction of the lower plate; and an lattice-patterned upper plate disposed on the lower plate so as to divide the opening of each unit structure into four parts, wherein an intersection P2 between a side-wall interface of a unit structure of any one sound absorption block and an upper plate line on the sound absorption block is stacked to be located in the same position as an intersection P1 of an upper plate line of another sound absorption block.

Advantages Effects

Meanwhile, a light source incident in one direction of the sound absorption block is passed through the other direction of the sound absorption block, while a light source incident in the other direction of the sound absorption block may not be passed through one direction of the sound absorption block if the light is reflected by coating with a light-reflecting material an outer surface of the sound absorption block according to the present invention. As a result, exposure of the private life, which is caused if the inner part of the next building is closely viewed, for example, through a window glass, etc. of a building, may be prevented in a building capable of attaining a constant illumination effect and a shading effect.

BRIEF DESCRIPTION OF THE DRAWINGS

These and other features, aspects, and advantages of preferred embodiments of the present invention will be more fully described in the following detailed description, taken accompanying drawings. In the drawings:

FIG. 1 is a perspective view showing a sound absorption block according to a preferred embodiment of the present invention;

FIG. 2 is a top view of FIG. 1;

FIG. 3 is a bottom view of FIG. 2;

FIG. 4 is a side view of FIG. 1;

FIG. 5 is another side view of FIG. 1;

FIG. 6 is a longitudinal cross-sectional view showing that two sound absorption blocks are stacked according to a preferred embodiment of the present invention; and FIG. 7 is a lateral cross-sectional view of FIG. 6.

BEST MODE FOR CARRYING OUT THE INVENTION

Hereinafter, preferred embodiments of the present invention will be described in detail with reference to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the present inventor is allowed to define terms appropriately for the best explanation.

FIG. 1 is a perspective view showing a sound absorption block according to a preferred embodiment of the present invention, FIG. 2 is a top view of FIG. 1, and FIG. 3 is a bottom view of FIG. 1.

Referring to FIGS. 1 to 3, the sound absorption block of the present invention includes a lower plate 10 and an upper plate 30. The lower plate 10 and the upper plate 30 are preferably made of the same materials, for example mild iron, aluminum, or an alloy thereof, which are metallic materials. However, the sound absorption block of the present invention may be manufactured using other building residues or synthetic resin because a sound wave is systemically decreased and offset regardless of the materials.

The lower plate 10 is configured so that a plurality of unit structures 12 are regularly arranged in horizontal and vertical directions. Preferably, the unit structure 12 has a rectangular shape, and is provided with a rectangular opening 14 in its inside. Accordingly, the unit structures 12 have a lattice pattern as whole where the openings 14 are regularly arranged, as shown in FIG. 3.

The size of the opening 14 is gradually decreased in a thickness direction of the lower plate 10. That is to say, the opening 14 is concave when it is viewed from above, as shown in FIG. 2, and convex when it is viewed from below, as shown in FIG. 3. For this purpose, each sidewall 12*a*, 12*b* of the unit structure 12 surrounding the opening 14 is inclined with the same angle. The angle is preferably 45° or less, and more preferably 30°. If the angle is greater than 45° or less than 25°, a sound-absorbing effect is lowered because an incident sound wave escapes outside without being decreased and offset by a reflected sound wave when the sound absorption blocks are stacked.

One sidewall 12*a* of each unit structure 12 is in contact with one sidewall 12*a* of another neighboring unit structure 12. Preferably, the contacted sidewalls 12*a*, 12*b* form a triangle due to their slant. For example, they form a protrusion 15 having a sharp ridge shape when it is viewed from a position above the lower plate 10, as shown in FIG. 2, and they form a groove 16 having a pointed valley shape when it is viewed from a position below the lower plate 10, as shown in FIG. 3. At this time, a base line of the sidewalls 12*a*, 12*b* forming the triangle, namely a distance L1 between the openings 14 of the lower plate 10 preferably has the same length as a width L2 of the opening 14 on the same line. An upper plate 30 of another sound absorption block is located on the groove 16 upon stacking the sound absorption blocks because most of the incident sound wave may be reflected when the distance L1 between the grooves and the width L2 of the opening 14 have the same length, as described above.

Meanwhile, a slit groove 18 is formed in a bottom surface of the lower plate 10, for example one side 14*a* of the rectangular opening 14, as shown in FIG. 4. Preferably, a pair of slit grooves 18 are provided on the sides 14*a*, 14*b* of the opposite opening (see FIG. 3), and the slit grooves should be generally arranged in the same direction for each of the systemically arranged unit structures 12. The sound absorption block is guided to an exact position by the slit groove 18 upon its stacking.

Also, a protrusion 20 is formed on the lower plate 10 to guide a position of the upper plate of another sound absorption block when a sound absorption block is stacked thereon. The protrusion 20 is formed one over two blocks in a longitudinal direction, and one over one block in a lateral direction, as shown in FIGS. 4 and 5, respectively, but not limitedly. For example, the position and number of the protrusions are suitably varied depending on the number and size of the unit structures 12 constituting the sound absorption block. The protrusion 20 preferably has a lower height than that of the upper plate 30 to fix a position of the sound absorption block upon its stacking.

Meanwhile, the upper plate 30 is fabricated by weaving band-type strips into a lattice pattern, and its distance is varied depending on the size of the lower plate 10. For example, the upper plate 30 is located on each of the unit structures 12 constituting the lower plate 10, as shown in FIGS. 1 to 3, and preferably located on the lower plate to divide the opening 14 of each unit structure 12 into four parts.

In other words, a lattice intersection P1 of the upper plate 30 is located at a center of the opening 14. At this time, a lattice spacing L3 of the upper plate 30 has the same length as a distance L4 of the unit structure 12 in the same direction.

Heretofore, a structure of the sound absorption block according to the present invention is described in detail, but the present invention is not limited thereto. For example, the lower plate 10 and the upper plate 30 are separately described above, but they may be integrally processed by such a casting. Also, it is possible to manufacture the sound absorption block into 10~20 subunit blocks, followed by manufacturing a desired size of the large sound absorption block by interconnecting them by means of soldering or the like.

Now, a method of constructing the sound absorption block manufactured as above will be described in detail with reference to FIGS. 6 and 7.

At least two sound absorption blocks are preferably stacked and used to construct the sound absorption block of the present invention on the wall surface. That is why a reflected wave is increased from an incident sound wave, and therefore the sound wave decreased and offset as the sound absorption block is stacked into multiple layers. Also, an effervescent synthetic resin such as styrofoam, sponge, etc. may be used together with the sound absorption block of the present invention to further improve the sound-absorbing effect.

First, a sound absorption block 1 of the present invention is constructed on a wall surface and a ceiling of the space to be sound-absorbed by means of conventional fixing methods. And another sound absorption block 2 is installed on the sound absorption block 1, an more specifically a lower plate of the another sound absorption block 2 is arranged to be positioned on an upper plate of the sound absorption block 1, as shown in FIG. 6.

That is to say, a first line 34 of the upper plate 30 of another sound absorption block 1 is positioned on the slit groove 18 in a longitudinal direction of the sound absorption block 2 (see FIG. 6), and a second line 36 of the another sound absorption block 1 is positioned on the groove 16 of the sound absorption block 2 in a lateral direction (see FIG. 7). At this time, the protrusion 20 of the sound absorption block 2 is press fit into the upper plate of another sound absorption block 1.

Then, the intersection P2 between the above-mentioned ridge-shaped interface of the sound absorption block 1 and the upper plate line 34 coincides with the intersection P1 of the upper plate line of the another sound absorption block 2, and the opening of the lower plate of the sound absorption block 2 is completely covered by the ridge-shaped sidewall of the another sound absorption block 1, therefore reflecting most of the incident sound wave, as shown in FIG. 1.

In addition, the upper plate line 34 of the sound absorption block 1 is preferably press fit onto the slit groove 18 of another sound absorption block 2 upon its stacking, as shown in FIG. 6. As a result, the stacked sound absorption block may be prevented from being detached from a binding position, and further the binding position may be suitably adjusted depending on an optimum stacking position when the sound absorption blocks are stacked into two, three layers or more.

Meanwhile, the sound absorption block may be used as materials for building for the shading purpose in addition to the sound absorption because the shading effect may be obtained in a certain direction if the light is reflected by coating an outer surface of the sound absorption block according to the present invention with light-reflecting materials. At this time, the light-reflecting materials may be formed into a metallic coating layer of a thin film, and the coating layer may also be formed using various materials recently known to be excellent in a light-reflecting performance.

As described above, the description proposed herein is just a preferable example for the purpose of illustrations only, not intended to limit the scope of the invention, so it should be understood that other equivalents and modifications could be made thereto without departing from the spirit and scope of the invention.

INDUSTRIAL APPLICABILITY

As described above, the sound absorption block according to the present invention and the method of constructing the same have the following effects.

First, it may be made of metallic materials, as well as inexpensive building residues, etc. because a sound wave is decreased and offset regardless of the materials.

Second, it may, if necessary, be fabricated with a variable size because it is blocked to regularly arrange the unit structures.

Third, it may realize an interior effect by installing the sound absorption blocks with different colors upon its construction because it is fabricated into a unit block.

The invention claimed is:

1. A sound absorption block, comprising; a lower plate in which a plurality of unit structures are regularly arranged in horizontal and vertical directions, the unit structure having a rectangular opening that becomes gradually smaller in a thickness direction of the lower plate; and an lattice-patterned upper plate disposed on the lower plate so as to divide the opening of each unit structure into four parts.

2. The sound absorption block according to the claim 1, wherein the opening becomes gradually smaller with an angle of 25 degrees to 45 degrees in the thickness direction.

3. The sound absorption block according to the claim 1, wherein a lattice-patterned groove is formed around each opening in a bottom surface of the lower plate.

4. The sound absorption block according to claim 1, wherein one sidewall of the unit structure forms a triangle with one sidewall of a neighboring unit structure, and a base line of the triangle has the same length as a width of the opening on the same line.

5. The sound absorption block according to the claim 4, wherein the unit structure has the same length as a line width of the upper plate on the same line.

6. The sound absorption block according to the claim 1, wherein a plurality of stacking protrusions are provided on a bottom surface of the lower plate.

7. The sound absorption block according to the claim 1, wherein a slit groove is formed in the opening of the lower plate to guide a location of the lower plate of the sound absorption block that is stacked.

8. The sound absorption block according to the claim 1, wherein an outer surface of the sound absorption block is coated with a light-reflecting material to realize a shading effect.

9. A method of constructing a sound absorption block, which stacks at least two sound absorption blocks to cross each other, each sound absorption block comprising a lower plate in which a plurality of unit structures are regularly arranged in horizontal and vertical directions, the unit structure having a rectangular opening that becomes gradually smaller in a thickness direction of the lower plate; and an lattice-patterned upper plate disposed on the lower plate so as to divide the opening of each unit structure into four parts, wherein an intersection between a side-wall interface of a unit structure of any one sound absorption block and an upper plate line on the sound absorption block is stacked to be located in the same position as an intersection of an upper plate line of another sound absorption block.

10. The method of constructing a sound absorption block according to the claim 9, wherein the upper plate of one sound absorption block is located on a slit groove formed on another sound absorption block.

* * * * *